United States Patent [19]

Nakano

[11] Patent Number: 4,969,409

[45] Date of Patent: Nov. 13, 1990

[54] NEEDLE PLATE HAVING RECESS FOR ACCOMMODATING LOOPER THREAD

[75] Inventor: Minoru Nakano, Osaka, Japan

[73] Assignee: Pagasus Sewing Machine Mfg. Co., Ltd., Osaka, Japan

[21] Appl. No.: 305,932

[22] Filed: Feb. 2, 1989

[51] Int. Cl.[5] ..... D05B 1/10

[52] U.S. Cl. ..... 112/260; 112/197

[58] Field of Search ..... 112/260, 199, 202, 197, 112/166, 200, 443, 159, 162, 80.3

[56] References Cited

U.S. PATENT DOCUMENTS

| | | | |
|---|---|---|---|
| 3,313,259 | 4/1967 | Daniel et al. | 112/260 |
| 3,491,710 | 1/1970 | Bowin | 112/260 |
| 4,175,500 | 11/1979 | Radice et al. | 112/260 X |
| 4,546,716 | 10/1985 | Babson et al. | 112/260 X |

*Primary Examiner*—Andrew M. Falik

*Attorney, Agent, or Firm*—Flynn, Thiel, Boutell & Tanis

[57] ABSTRACT

In a needle plate used in a sewing machine for forming double chain stitches, a recess is formed at a looper heel side of a needle hole behind a needle drop point. During the sewing of a fabric, the loop of the looper thread expands by tensioning of the needle thread and settles within the recess, so that balloon stitches are formed on the under side of the fabric.

2 Claims, 4 Drawing Sheets

NEEDLE PLATE HAVING RECESS FOR ACCOMMODATING LOOPER THREAD

BACKGROUND OF THE INVENTION

1. Field of the Invention

This invention relates to a needle plate for a sewing machine which forms double chain stitches, and more particularly to a needle plate for guiding a thread loop making the stitches on the underside of fabric round and soft.

2. Description of the Prior Art

Double chain stitches appear on the underside of fabric as a looper thread is laid in triple and tacked by the needle thread at every stitch, and each stitch can be varied according to sewing conditions, especially by the balance of the thread tension between the needle thread and the looper thread. That is, when the tension of the needle thread is high, the looper thread is divided into three parts and the stitches look round and soft as shown in FIG. 5, and when the tension of the looper thread is high, as shown in FIG. 6, the looper thread becomes like a rope, as if made of two threads. The former stitches are called balloon stitches, which are used in stretchable knit fabrics or other soft-hand materials, while the latter stitches are used in stiff and less stretchable woven fabrics. However, when the tension of the needle thread is increased in order to obtain balloon stitches, the supply of needle thread for making the stitches decreases, and puckering may occur in the sewn product. On the other hand, if the tension of the looper thread is reduced to be less than that normally used with the needle thread, since the tension of the looper thread is initially set at more than several times lower than that of the needle thread, there is a lower limit for loosening the looper thread, and, if set too low, may give rise to skipped stitches or other sewing defects.

SUMMARY OF THE INVENTION

It is therefore a primary object of this invention to present a needle plate for a sewing machine for forming double chain stitches which guides a thread loop composing the stitches on the underside of fabric, so that the double chain stitches have a soft appearance of the looper thread which is divided into three parts, and of which, the loop is round and soft, that is, so-called balloon stitches, without causing puckering.

To achieve the above and other objects, this invention presents a needle plate for a sewing machine for forming double chain stitches of Federal Standard stitch type 401 with a need thread and looper thread through cooperation with a needle and looper. The sewing machine which comprises a needle moving up and down through a needle drop point of a needle hole provided in the needle plate, and a looper moving in a reciprocating fashion in a direction orthogonal to the fabric feed direction beneath the needle plate. The needle hole has a recess behind the needle drop point at the heel side of the looper to provide a broad, hollow area in the needle plate horizontally and orthogonally to the fabric feed direction so that the width of the needle hole at the recess is wider than the needle hole at the needle drop point and, when the looper thread is pulled up by tensioning the needle thread, a slack loop of the looper thread expands and spreads to settle in the recess.

DESCRIPTION OF THE PREFERRED EMBODIMENT

Figure 1:
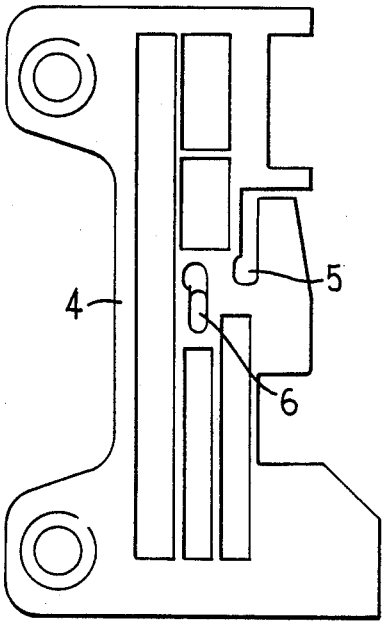
FIG. 1 is a plan view of a needle plate used in a safety stitch sewing machine for sewing double chain stitches and overedge stitches.
Figure 2:
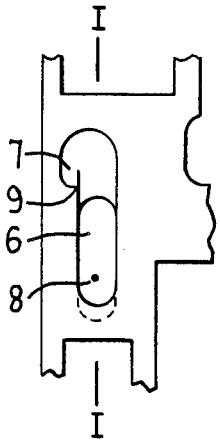
FIG. 2 is an enlarged view of a marginal part of the needle hole in the needle plate of FIG. 1.
Figure 3:
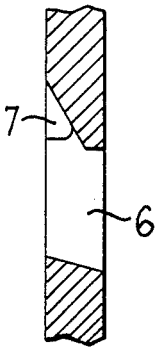
FIG. 3 is a sectional view taken along section line I—I of FIG. 2.

Referring first to FIG. 1, a needle plate 4 for a safety stitch sewing machine comprises a needle hole 5 for overedge stitches, and a needle hole 6 for double chain stitches, with the needle hole 6 for double chain stitches having a recess 7 of which an end is located two to five stitches in length behind a needle drop point 8 at the left side (looper heel side) of the needle hole 6. That is, the recess 7 provides a wide horizontal hollow area contiguous to the delivery side of the needle hole 6.

Figure 4:
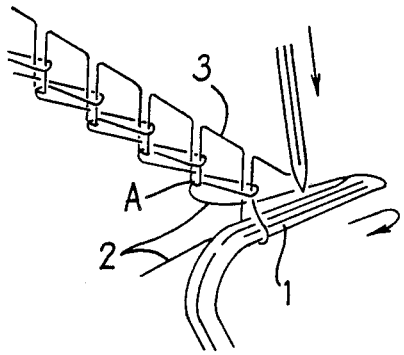
FIG. 4 is a perspective view showing double chain stitches being formed.
Figure 5:
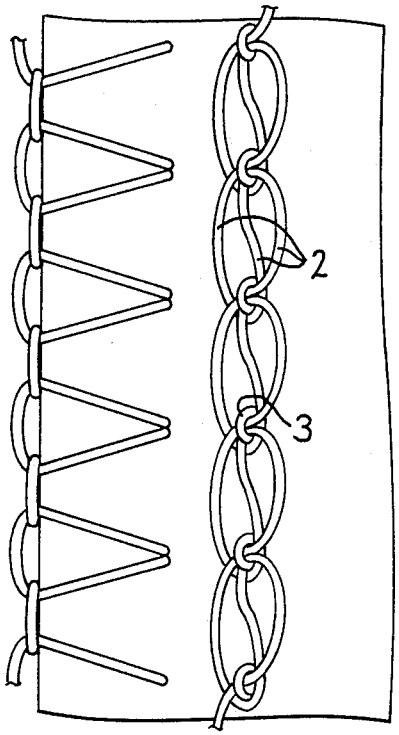
FIG. 5 is an underside view of double chain stitches formed in a fabric by a safety stitch sewing machine.
Figure 6:
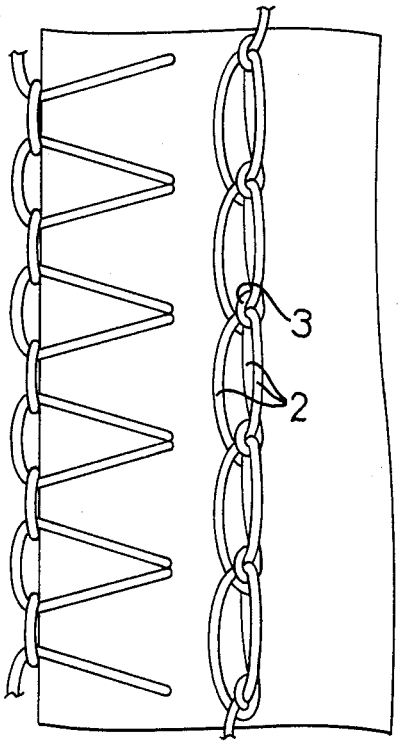
FIG. 6 shows the rope-shaped double chain stitches formed in the underside of a fabric.
Figure 8:
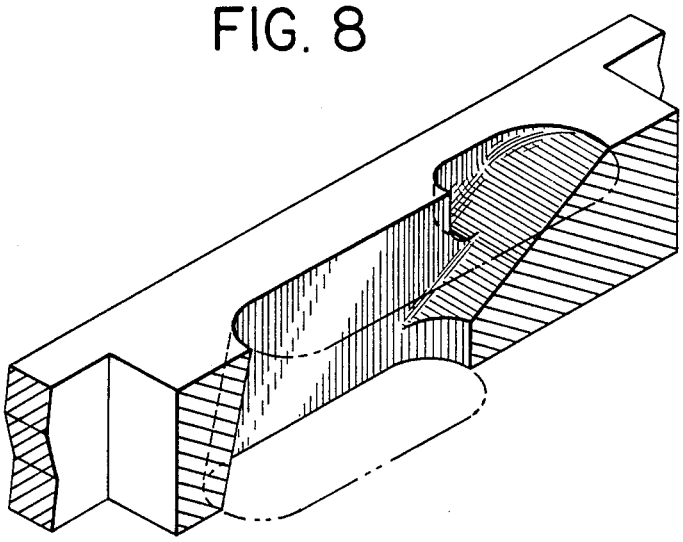
FIG. 8 is a perspective view of the needle plate of FIG. 2 taken along section line I—I.

For forming double chain stitches, as shown in FIG. 4, after a looper 1 reaches the right end point, the looper 1 reverses and runs leftward, and then the tension of a looper thread 2 reduces to zero, and the looper thread 2 is rounded to make a loop between the looper end and the crossing point A of the needle thread 3 of the preceding stitch. By tensioning of the needle thread 3, the loop expands horizontally and roundly along the wall of recess 7. This expansion is in the vertical direction in conventional needle plates. In particular, when the needle for double chain stitching is inclined the same as the needle for overedge stitching in conventional safety stitch sewing machines and the needle hole 6 is a slit as shown in FIG. 1, the loop expands along the slit and, after stitching, the appearance of the stitches on the underside of the fabric looks like a rope having the thread overlapped up and down as shown in FIG. 6. By contrast, when the recess 7 is formed behind the needle drop point 8 at the looper heel side, when the looper thread 2 is pulled up by the needle thread 3, the loop of the looper thread 2 spreads widely and settles in the recess 7, so that the appearance of the stitches after sewing looks as shown in FIG. 5.

In the illustrated embodiment, the recess 7 has a bottom, but it may also be a through-hole continuous to the needle hole 6. The side wall of the recess 7 may be formed to be nearly orthogonal to the needle hole 6, or curved or inclined. But it is preferable to form the recess with a bottom and a corner edge 9 as shown in the illustrated example, between the recess 7 and the needle hole 6, so that the expansion of the loop may be securely held within the recess 7.

The foregoing embodiment relates to a needle plate of a safety stitch sewing machine, but in other embodiments, it may be also applied to a needle plate for a sewing machine for forming only double chain stitches. In such a needle moves plate, the needle vertically up and down, and the needle hole is formed vertically in a circular section, but in this case, too, the recess for accommodating the expansion of the loop of looper thread is formed adjacent to the needle hole and an end of the recess is located 2 to 5 stitches length behind the needle drop point, at the looper heel side of the needle hole.

The fabrics that can be sewn by the needle plate of this invention are not limited and range from thick fabrics jeans to thin materials for such as shirts and blouses.

EXAMPLE

Figure 7:
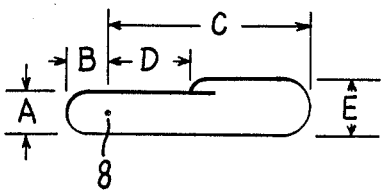
FIG. 7 is a top view of the needle hole to show dimensions of the hole.

With respect to the needle hole shown in FIG. 7, needle plates within the scope of the present invention and having the following respective dimensions A: 1.0 mm, B: 1.0 mm, C: 6.3 mm, D: 2.3 mm, E: 1.5 mm: A: 1.6 mm, B: 1.6 mm, C: 6.3 mm, D: 2.3 mm, E: 2.1 mm: and A: 1.8 mm, B: 1.8 mm, C: 7.2 mm, D: 4.0 mm, E: 2.3 mm, and also a conventional needle plate without a recess were tested on jean fabrics which were sewn with a cotton sewing thread of 20/3, conforming to the Japanese Industrial Standard, at a sewing pitch of 8 stitches/inch (the length of one seam: 3.2 mm). As a result, in order for the conventional needle plate to obtain balloon stitches with open loops of the looper thread as shown in FIG. 5, the needle thread tension had to be 100 grams, and a slight puckering phenomenon was noted in the sewn products. By contrast, when the needle plates of the present invention were used, the loops were sufficiently opened at a needle thread tension of only 60 grams, soft seams were obtained, and puckering was not observed.

What is claimed is:

1. A needle plate for a sewing machine which has a needle that moves vertically up and down through a needle hole provided in the needle plate, said needle hole being completely enclosed by said needle plate, a looper which moves underneath said needle plate in a reciprocating motion orthogonal to a fabric feed direction and forms double chain stitches with a needle thread and a looper thread, said needle plate comprising a recess provided in said needle hole, said recess being located in said needle hole behind a needle drop point and in a direction orthogonal to said fabric feed direction and adapted to accommodate a loop of said looper thread, and said needle hole being wider in the portion which contains said recess than in the portion said needle moves through.

2. A needle plate according to claim 1, wherein the recess has a bottom and a corner edge between the recess and the needle hole.

* * * * *